United States Patent [19]

Tsai

[11] Patent Number: 4,769,855

[45] Date of Patent: Sep. 13, 1988

[54] BABY'S NIGHT GOWN

[75] Inventor: Ming-Ling Tsai, Taichung Hsien, Taiwan

[73] Assignee: Elephant Garment Co., Ltd., Taichung Hsien, Taiwan

[21] Appl. No.: 6,138

[22] Filed: Jan. 23, 1987

[51] Int. Cl.[4] ..... A41B 9/00

[52] U.S. Cl. ..... 2/114; 2/DIG. 6; 2/DIG. 7

[58] Field of Search ..... 2/DIG. 6, 114, DIG. 7, 2/69, 69.5, 75, 83, 74, 48, 2

[56] References Cited

U.S. PATENT DOCUMENTS

| | | | |
|---|---|---|---|
| 2,157,460 | 5/1939 | Robertson | 2/74 |
| 2,244,583 | 6/1941 | Turner et al. | 2/74 |
| 2,589,596 | 3/1952 | Auer | 2/114 |
| 2,717,437 | 9/1955 | DeMestral | 2/DIG. 6 |
| 3,034,132 | 5/1962 | Landsberger et al. | 2/DIG. 6 |
| 3,114,951 | 12/1963 | DeMestral | 2/DIG. 6 |
| 3,136,026 | 6/1964 | DeMestral | 2/DIG. 6 |
| 3,339,209 | 9/1967 | Larson | 2/74 |
| 3,357,385 | 1/1971 | Hendrickson | 2/114 |
| 4,497,069 | 2/1985 | Braunhut | 2/DIG. 6 |
| 4,674,130 | 6/1987 | Coudron | 2/DIG. 7 |

FOREIGN PATENT DOCUMENTS

| | | | |
|---|---|---|---|
| 597979 | 9/1959 | Italy | 2/69.5 |

*Primary Examiner*—Ronald Feldbaum

*Attorney, Agent, or Firm*—Browdy and Neimark

[57] ABSTRACT

A baby's night gown which includes a front piece, a back piece, and a left and a right belly band and which is characterized by having practical and useful advantages and benefits, such as, maintaining stable location and being ready to wear, etc. is disclosed.

8 Claims, 1 Drawing Sheet

BABY'S NIGHT GOWN

BACKGROUND OF THE INVENTION

The present invention relates to a baby's night gown which is characterized by having a front piece and a back piece designed to be seamed at the shoulder only and provided with a neck opening, as well as a left and a right belly band protruding from and stitched at the middle of the back piece. The baby's night gown of the present invention can provide the practical benefits and advantages, e.g., good coverage and protection of the baby's belly, as well as being fixative and easy wearing.

A conventional baby's night gown comprises a back piece, and two front pieces separated and superimposed each other. The night gown is also provided with a neck opening and a left and a right sleeve opening. Additionally, a string is provided on each of the left and right edge of both front pieces to be tied up on the back while wearing. Alternatively, two separate front pieces are tailored symmetrically and provided with buttons and buttonholes for fixing the night gown completed by way of fastening them. While wearing, both baby's hands should go through the cuffs. However, because the distance between the cuffs are fixed and can not be adjusted appropriately, the baby's hands must be guided through the cuffs with much effort. It is quite inconvenient and often makes the baby uncomfortable or even causes the baby to cry by being misguided. After both hands have been passed through the cuffs, the night gown then is located with strings or buttons. It is thus inconvenient as well as time consuming and labor consuming. For the belly is the weakest portion of a baby, if the belly is not protected properly, the baby might catch cold easily. Conventional night gowns do not have specific fixation structures and can not be located with respect to the inner garments, therefore they might slip away when the baby is moving and make the baby easily catch a cold. In other words, a conventional baby's night gown has many disadvantages, such as, inconvenience, and discomfort in wearing and poor fixature, and it may also restrict a baby's motion.

In view of this, the inventor endeavored to design a baby's night gown with creative construction which can provide the benefit of being ready to wear, which securely encircles a baby's legs and belly, and the present invention is completed with success to replace a conventional baby's night gown.

SUMMARY OF THE INVENTION

A major object of the present invention is to provide a baby's night gown for convenient and simple wearing. The night gown of the present invention is characterized in that a front piece and a back piece are designed to be seamed at the shoulder only and provided with a neck opening, and band shaped fasteners are provided on the inner side of both edges. A baby puts his head through the neck opening and then raises both hands for buckling the front piece and the back piece together form the cuff, thus completing the action of putting on the night gown.

Another object of the invention is to provide a baby's night gown with a creative construction which can be stably located to protect the baby's belly from catching a cold, and which is characterized by a left and a right belly band protruding from the left and the right edges of the back piece respectively, and a Velcro or band shape fastener being stitched thereon to wrap round the baby's belly stably and securely.

BRIEF DESCRIPTION OF THE DRAWINGS

With respect to the characteristics of the construction, an embodiment of the invention will be described in reference to the drawings as follow.

In the drawings.

DETAILED DESCRIPTION

Figure 1:
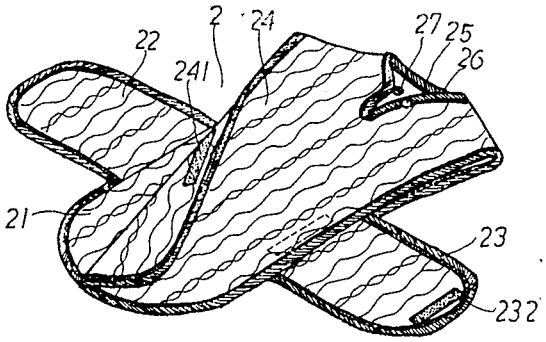
FIG. 1 is a perspective view of the baby's night gown in accordance with the invention.
Figure 2:
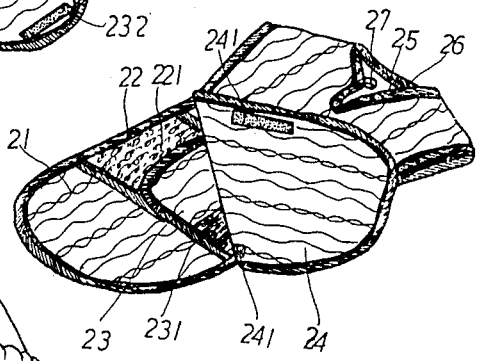
FIG. 2 is a schematic diagram of the practice example of the invention.

With reference to FIGS. 1 and 2, a baby's night gown 2 of the present invention comprises a back piece 21 and a front piece 24 seamed together at the top edge, and a left and a right belly band 22, 23 stitched at the left and right edge of the back piece respectively. A neck opening 25 is provided at the middle of the suture line between the front and the back piece. Button 26 and buttonhole 27 are provided at the central section of the neck opening 25 to be buckled up. A band shape fastener 232 is provided at the front edge of the left belly band 23, and a band shape fastener 231 is provided near the back joining line of the back piece 21. A band-shape fastener 221 is provided on the full back side of the right belly band 22 to be buckled up with the band shaped fastener 232 of the left belly band 23. Band shape fasteners 241 are sewn up at the corresponding places on the left and right inner side of the front piece 24 respectively to be buckled up with the band shaped fasteners 221, 231 mounted on the left and right belly band 22, 23 and form the cuffs from the buckling point for the front and back piece 24, 21 up to the shoulder. The construction of the night gown of the invention may offer easy wearing, effective wrapping, catching-cold inhibition, sufficient moving range and other useful benefits superior to the traditional night gowns.

Figure 3:
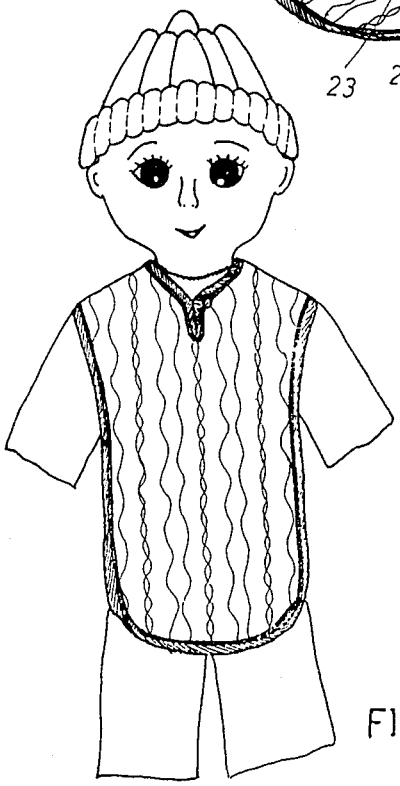
FIG. 3 is a schematic diagram of an embodiment of the invention.

While putting on the night gown, the neck opening is put round the baby's neck and the baby raises both hands for buckling the left and right belly bands 23, 21 over the belly. After which, the front piece 24 is layered over them and the action of wearing the night gown is completed as shown in FIG. 3. The disadvantages of traditional ones like the inconvenient and difficult guiding of both hands through the cuffs can be avoided. Additionally, the useful and practical advantages like simple and stable wearing can be enhanced.

The band shape fastener referred herein is preferably VELCRO, but the equivalent articles to VELCRO encompassed within the scope of the invention.

In view of the foregoing description, those of ordinary skill in the art will undoubtedly envision various modifications to the present invention. It is therefore expressly intended that the above description should be considered as only that of the preferred embodiment. The true spirit and scope of the present invention may be determined by reference to the appended claims.

I claim:

1. A night gown, comprising:

a front piece for covering the front of a wearer of the night gown when in use;

a back piece for covering the back of the wearer of the night gown when in use, said front piece and said back piece being connected to one another at the tops thereof;

a neck opening in said connected front and back pieces through which the neck of the wearer passes when the night gown is in use;

first and second belly bands respectively connected to opposite sides of said back piece intermediate the top and bottom thereof, said belly bands being shaped and sized to extend around the wearer and over the belly of the wearer when in use;

first connecting means for connecting said first and second belly bands to one another at the front of the wearer and beneath said front piece when in use said first connecting means comprising a first fastener provided on an inner side of said first belly band and a second fastener provided on an outer side of said second belly band positioned to connect with said first fastener when in use; and second connecting means for connecting said front piece to said connected first and second belly bands at the front of the wearer when in use said second connecting means comprising, a third fastener provided on an outer side of said first belly band;

a fourth fastener provided on an outer side of said second belly band; and inwardly facing fifth fastener provided on both borders of an inner side of the front piece positioned to connect with said third and fourth fasteners when in use, wherein said fifth fasteners are adapted to connect with said third and fourth fasteners when in use to close the night gown.

2. A baby's night gown as claimed in claim 1 wherein said band shape fastener is preferably a Velcro.

3. The night gown according to claim 1, wherein said front and back pieces are stitched to one another along a seam line and said first and second belly bands are stitched to said back piece along seam lines.

4. The night gown according to claim 3, wherein said neck opening is positioned at a substantially middle portion of the seam line connecting said front and back pieces together.

5. The night gown according to claim 1, wherein said neck opening is provided with buttons and buttonholes for fastening the front end of said neck opening.

6. The night gown according to claim 4, wherein said first and second fasteners are made of VELCRO.

7. The night gown according to claim 1, wherein said third, fourth and fifth fasteners are made of VELCRO.

8. The night gown according to claim 1, wherein said first, second, third, fourth and fifth fasteners are made of VELCRO.

* * * * *